US012077966B2

(12) United States Patent
Braun et al.

(10) Patent No.: US 12,077,966 B2
(45) Date of Patent: Sep. 3, 2024

(54) ACOUSTIC PANEL COMPRISING OFFSET GROOVES

(71) Applicant: SWISS KRONO TEC AG, Lucerne (CH)

(72) Inventors: Roger Braun, Willisau (CH); Jonathan Wyss, Rüedisbach (CH)

(73) Assignee: SWISS KRONO TEC AG, Lucerne (CH)

( * ) Notice: Subject to any disclaimer, the term of this patent is extended or adjusted under 35 U.S.C. 154(b) by 269 days.

(21) Appl. No.: 17/620,908

(22) PCT Filed: Jun. 9, 2020

(86) PCT No.: PCT/EP2020/065976
§ 371 (c)(1),
(2) Date: Dec. 20, 2021

(87) PCT Pub. No.: WO2020/254155
PCT Pub. Date: Dec. 24, 2020

(65) Prior Publication Data

US 2022/0349186 A1 Nov. 3, 2022

(30) Foreign Application Priority Data

Jun. 18, 2019 (EP) ..... 19180993

(51) Int. Cl.
*E04F 13/08* (2006.01)
*E04B 1/99* (2006.01)

(52) U.S. Cl.
CPC ..... *E04F 13/0867* (2013.01); *E04B 1/99* (2013.01); *E04F 13/0894* (2013.01); *E04F 2201/02* (2013.01); *E04F 2201/043* (2013.01)

(58) Field of Classification Search
CPC ..... E04F 13/0867; E04F 13/0894; E04F 2201/02; E04F 2201/043; E04F 2201/0495; E04B 1/99; E04B 2001/8495
See application file for complete search history.

(56) References Cited

U.S. PATENT DOCUMENTS

2008/0289901 A1* 11/2008 Coury ..... E04B 9/001 181/286
2017/0037640 A1* 2/2017 Boucké ..... E04F 15/02038

FOREIGN PATENT DOCUMENTS

CH 352124 A * 2/1961
DE 102004026644 A1 * 3/2005 ..... E04B 1/86
(Continued)

OTHER PUBLICATIONS

International search report for patent application No. PCT/EP2020/065976 dated Jul. 14, 2020.

*Primary Examiner* — Christine T Cajilig
(74) *Attorney, Agent, or Firm* — Bachman & LaPointe, P.C.

(57) ABSTRACT

The invention relates to an acoustic panel (1) for producing a wall and ceiling lining, comprising a front face (2) and a rear face (3) and recesses (4, 6) which extend from the front face (2) and from the rear face (3) into the acoustic panel. In order to provide an acoustic panel which both prevents the ability to see through from the front face to the absorber and also prevents particles from passing from the absorber through the acoustic panel (1), according to the invention at least one front-face recess and one rear-face recess (6) are arranged so as to be partially offset from one another and comprise a through-opening (7).

14 Claims, 2 Drawing Sheets

(56) References Cited

FOREIGN PATENT DOCUMENTS

| | | | | | |
|---|---|---|---|---|---|
| DE | 202004021131 | U1 | | 11/2006 | |
| EP | 1508651 | A2 | * | 2/2005 | ..... E04B 1/86 |
| EP | 3112545 | A2 | | 1/2017 | |
| GB | 1147428 | A | * | 4/1969 | |
| WO | 2012059899 | A2 | | 5/2012 | |

* cited by examiner

ACOUSTIC PANEL COMPRISING OFFSET GROOVES

BACKGROUND OF THE INVENTION

The invention relates to an acoustic panel for producing a wall and ceiling covering and to a wall and ceiling covering.

Acoustic panels are known both as single-layer and double-layer components. In this case, these acoustic panels generally have a carrier board with a visible face which is decoratively designed. An acoustic absorber is arranged on the rear face opposing the visible face. The visible face with the carrier board has recesses, sound waves which occur in a room penetrating through said recesses and passing through the carrier board into the absorber. Depending on the size of the recesses, the absorber is visible through the recesses. This is troublesome, in particular, when the color of the absorber does not correspond to the color of the carrier board or, respectively, the visible face. A further known problem is that specifically in absorbers made of fibers, due to vibrations or shocks, fibers or even pieces of material are detached from the absorber and pass through the recesses, for example on the floor of the room. This problem is known specifically in two-part systems in which the absorber is initially fastened to the substrate and then the acoustic panel is mounted on the absorber. Acoustic panels are known, for example, from DE 20 2004 021 131 U1 and WO 2012/059899 A2.

A known solution therefor is to attach a fleece to the rear face of the acoustic panel which is adapted firstly in terms of color to the front face and secondly to the flow properties of the absorber in order to prevent particles from passing out of the absorber through the recesses. The fleece, however, is associated with various production difficulties.

Thus, for example, in the case of different primary colors of the front face, i.e. the visible face of the acoustic panel, different primary colors would have to be used in the acoustic fleece. Additionally, bonding difficulties frequently occur when bonding the fleece to the rear face of the acoustic panel. Subsequent working operations are also significantly more difficult to carry out since the pressure stability of the fleece or even the possibilities of suctioning during working operations are significantly limited by the fleece.

SUMMARY OF THE INVENTION

The object of the invention is to provide an acoustic panel and a wall and ceiling covering made of acoustic panels which both prevents the ability to see through from the front face to the absorber and also prevents particles from trickling from the absorber through the acoustic panel.

The invention solves the object by an acoustic panel having the features disclosed herein and a wall and ceiling covering having the features disclosed herein. Advantageous developments of the invention are specified herein and in the dependent claims. In this case all of the described features in principle form the subject matter of the invention per se or in any combination, irrespective of the summary thereof in the claims or the back reference thereof.

The acoustic panel according to the invention for producing a wall and ceiling covering comprises a front face and a rear face with recesses which extend from the front face and from the rear face into the acoustic panel. In this case, at least one front-face recess and one rear-face recess are arranged so as to be partially offset to one another and a through-opening is present between the front-face and rear-face recess.

A basic idea of the invention is that recesses configured for absorbing sound waves are configured as two parts in the acoustic panel. In this case, as described above, a front-face recess is incorporated in the acoustic panel from the front face. However, the recess does not penetrate the acoustic panel entirely. A second rear-face recess is incorporated from the rear face and also does not penetrate the acoustic panel entirely but only sufficiently far that a through-opening is produced between the front-face and the rear-face recess.

In this case, the front-face recess is arranged offset to the rear-face recess in the acoustic panel. In other words, the recesses are configured so as to be offset to one another in the direction transversely to the panel plane (called the horizontal direction hereinafter). It is brought about by means of the offset that from the front face it is possible to view the offset and thus the interior of the acoustic panel but not the absorber, whilst from the rear face the offset captures fibers or particles detached from the absorber. The sound waves penetrating from the front face into the acoustic panel may also penetrate through the through-opening into the absorber.

The recesses in this case are arranged and configured such that they extend, in particular, in the vertical direction, i.e. perpendicular to the panel plane into the acoustic panel.

The vertical central axes of the front-face and rear-face recesses are thus arranged offset to one another in the horizontal direction. A congruence of the perpendicular central axes of the recesses is not present.

The acoustic panels generally have a carrier board which is coated on the front face with a decorative layer which forms the visible face. In this case, the decorative layer, for example, may be pressed on, such as a synthetic resin laminate, or may be configured as a lacquered-on decorative layer and/or as a laminated-on decorative layer. A possible rear-face coating is generally correspondingly adapted to the front face coating.

The recesses thus protrude through the front-face and optionally rear-face coating.

The carrier boards may be deployed as wood-based material boards, such as for example fiber boards, particle boards or OSB boards. The carrier boards, for example, may also comprise composite materials made of, in particular, cellulose-based particles, such as for example wood or paper with a corresponding matrix material, such as for example plastics. Carrier boards which have synthetic fibers may also be used. The carrier boards may additionally contain, in particular, fire retardant agents in order to meet the correspondingly required fire protection requirements.

As already set forth above, the recesses extend from the front face and/or from the rear face in the vertical direction (perpendicular to the panel plane) in each case to the opposing face (front face or rear face) of the acoustic panel. In this case, the recesses are not entirely offset to one another but only partially, whereby the through-opening is produced.

In particular in order to adapt the size of the through-opening and thus also to control the extent of the passage of sound waves from the front-face recess through the rear-face recess into a possible absorber, according to a development of the invention it is provided that the front-face and the rear-face recess overlap one another in the direction perpendicular to the panel plane and the through-opening is arranged, in particular, in an overlapping portion of the recess.

In other words, in addition to the offset in the horizontal direction (generally transversely to the panel longitudinal direction) an offset (overlap) is also present in the vertical direction (generally in the direction of the panel thickness) of the recesses. The spacing between the front face and a recess base of the front-face recess (deepest point of the recess in the acoustic panel) is thus in any case greater than the spacing of the recess base of the rear-face recess relative to the front face.

In this case the actual depth of the respective recess base may be designed to be differently. Thus, for example, the absolute depth of the front-face recess, i.e. the spacing from the front face to the front-face recess base, may be significantly less than the spacing from the rear-face recess base to the rear face. According to a development of the invention, however, it is provided that in the case of two recesses forming a through-opening, the front-face recess protrudes more deeply into the acoustic panel relative to the rear-face recess, whereby in particular the overall view of the front face of the acoustic panel is significantly improved.

In order to achieve an optimal effect, in particular for the visual effect, i.e. for viewing the acoustic panel, according to a development of the invention it is provided that the ratio between the panel thickness and the depth of the front-face recess and the depth of the rear-face recess is between 10:7:6 to 13:9:5.

The panel thickness in this case refers to the total thickness of the acoustic panel, i.e. including the front-face and optionally rear-face coating. Accordingly, in the case of the depth of the front-face recess, the depth from the front face, i.e. including the possible upper-face coating, also has to be considered and/or in the case of the depth of the rear-face recess the depth from the rear face, i.e. including the possible rear-face coating, also has to be considered.

In addition to the depth of the recesses, the width of the recesses is also relevant for the acoustic effect. Thus it has been shown that for a particularly good acoustic effect the front-face recess has a width ratio of 2.5:3 relative to the rear-face recess.

A particularly preferred embodiment of the acoustic panels provides that the recesses are configured as grooves which are present, in particular, in a slot-shaped manner in the acoustic panel. Specifically when designed as grooves, the preferred width ratio brings about a particularly good acoustic effect. The grooves may be configured to be rectangular or square in cross section. The grooves extend, for example, transversely to the panel longitudinal direction but, in particular, in the longitudinal axial direction of the acoustic panel. A particularly preferred embodiment in visual terms additionally provides that the front-face recesses are inset, i.e. the front-face recesses, in particular the grooves, do not extend over the entire panel length or panel width, but a panel portion is present on the respective outer edges which may be, for example, 2 to 5 cm width, in which no recesses are arranged. In order to improve further the acoustic effect in such a front-face design, it is additionally preferably provided that the lower-face recesses extend over the entire panel length. If the visual effect of a continuous groove were to be desired on the front face, it is additionally possible to add so-called decorative grooves which visually lengthen the actual acoustic recesses as far as the respective outer edge of the acoustic panel but only have a small depth, for example a depth ranging from 1 to 2 mm.

In principle, the through-openings are able to be individually designed. Thus when designing the recess as a hole, for example, the through-opening may also be correspondingly present as a round or oval hole, optionally also as rectangular openings. It is particularly preferred, however, that the through-opening extends over the entire length of the front-face recesses. As a result, it is ensured that the sound waves penetrating from the front face into the recess are conducted substantially entirely through the acoustic panel and, for example, into an absorber.

In principle, the cross section of the recesses may be configured in a variable manner. Thus it is conceivable, for example, that the recess is configured in the region of its recess base to be semi-circular, in an oblique manner, or the like. Particularly preferably, however, the recesses in each case have a fold which is present in the region of the recess base thereof. In this case, the fold is configured, in particular, as a 90° fold, whereby firstly the non-transparency from the front face and secondly also the inability of particles to pass through from the rear face to the front face may be ensured in a particularly effective manner.

In order to improve both the acoustic effect of the acoustic panel and further minimize the ability of the particles to pass through from the rear face in the direction of the front face, according to a development of the invention it is provided that the lower-face recesses are configured to open toward the rear face. In other words, the lower-face recesses starting from the rear face, for example, are trapezoidal in cross section (in particular an isosceles trapezoidal shape), wherein the short parallel surface of the trapezoid forms the recess base. In this case it has been surprisingly shown that a particularly high acoustic effectiveness is present when the side surfaces (for example the diagonals of the trapezoid) of the recesses are arranged at an angle of 23°+/−2° to the vertical axis of the acoustic panel. Particularly advantageously, the rear-face recesses thus have the shape of an isosceles trapezoid with the above-mentioned angles between the short parallel lines (recess base) and the two side surfaces (diagonal lines).

The recess which opens toward the rear face permits a further preferred embodiment, according to which the plane formed by the through-opening is located in an oblique manner to the vertical axis. As a result, the possibility of the passage of sound waves from the front face to the rear face is significantly improved.

The configuration of the options for connecting the acoustic panels to one another may vary. Thus, for example, these acoustic panels may abut one another. Conventional tongue and groove connections are also conceivable. According to the invention, however, the acoustic panels have locking profiles, in particular turn-swivel and/or push button profiles, which correspond to one another and which are lockable to one another without the use of adhesive, on at least two opposing side edges. Such locking profiles generate a connection without joints and steps between two acoustic panels which remain permanently. The locking profiles ensure that in the case of swelling and shrinking movements of the individual acoustic panels, or even the entire panel surface, a connection is always present between the individual acoustic panels without steps and joints. The locking profiles simplify the assembly of the acoustic panels relative to acoustic panels having conventional tongue and groove profiles, or even acoustic panels without profiles.

A profile plane is configured by the locking profiles. This profile plane, starting from the front face, is located at the deepest point of the locking profiles and extends parallel to the front face and rear face. In order to generate an optimal acoustic effect and additionally also to prevent in the best possible manner the transparency through the recesses and/or to block the trickling through of particles from the rear face to the front face, according to the invention it is provided that the front-face recess protrudes below the profile plane of the acoustic panel.

The above-mentioned locking profiles, in particular the turn-swivel or push button profiles, generally have a first profile with an upper groove cheek and a second locking profile corresponding thereto with a lower groove cheek. The assembly of the acoustic panels, in particular in the wall region, takes place generally such that the acoustic panels are assembled starting from the side edge with the upper groove cheek.

In order to prevent the trickling through of particles from the rear face to the front face even more comprehensively, according to a development of the invention it is provided that in the case of two recesses forming a through-opening, the spacing of the rear-face recess from a side edge with the upper groove cheek is smaller relative to the spacing of the front-face recess from the side edge with the upper groove cheek. As a result, specifically in the case of wall panels, particles which are detached from an absorber arranged on the rear face are captured in the rear-face recess. The step which is present between the front-face and rear-face recess due to the offset prevents these particles from passing through to the front face due to vibrations, or the like, in a particularly effective manner.

A further improvement of the acoustic effectiveness is surprisingly achieved by a recess which is provided in the front-face region with a fold and/or two folds which increases the width of the recess in the region of the fold. Thus according to a development of the invention it is provided that the front-face recess is 10% to 50% wider relative to the recess width itself, in the region up to a depth of 20% of its total depth.

The object is also solved by a wall and ceiling covering comprising a plurality of acoustic panels of the aforementioned type which are fastened to a substructure, wherein a sound-attenuating absorber is arranged adjoining the rear face.

The wall and ceiling covering advantageously has no further protective layer, for example a fleece layer between the rear face of the acoustic panel and an absorber. The absorber is thus directly arranged on the rear face of the acoustic panel. The view, as well as the possible trickling of particles from the absorber, through the front-face and rear-face recesses is successfully prevented by the offset arrangement of the front-face and rear-face recesses in the acoustic panel.

The rear-face absorber may naturally be connected, for example bonded, to the rear face of the acoustic panel, but in particular it is not connected to the acoustic panel but configured as a separate component. The absorber is either directly fastened to the substructure or optionally also to a component (for example a wall or ceiling) to which the substructure is fastened. Naturally, the wall and ceiling covering may also be arranged on an intermediate wall formed by the substructure or a freely suspended substructure and, for example, form the intermediate wall or suspended ceiling therewith.

BRIEF DESCRIPTION OF THE DRAWINGS

The invention is described in more detail hereinafter with reference to a plurality of exemplary embodiments, in which.

DETAILED DESCRIPTION

Figure 1:
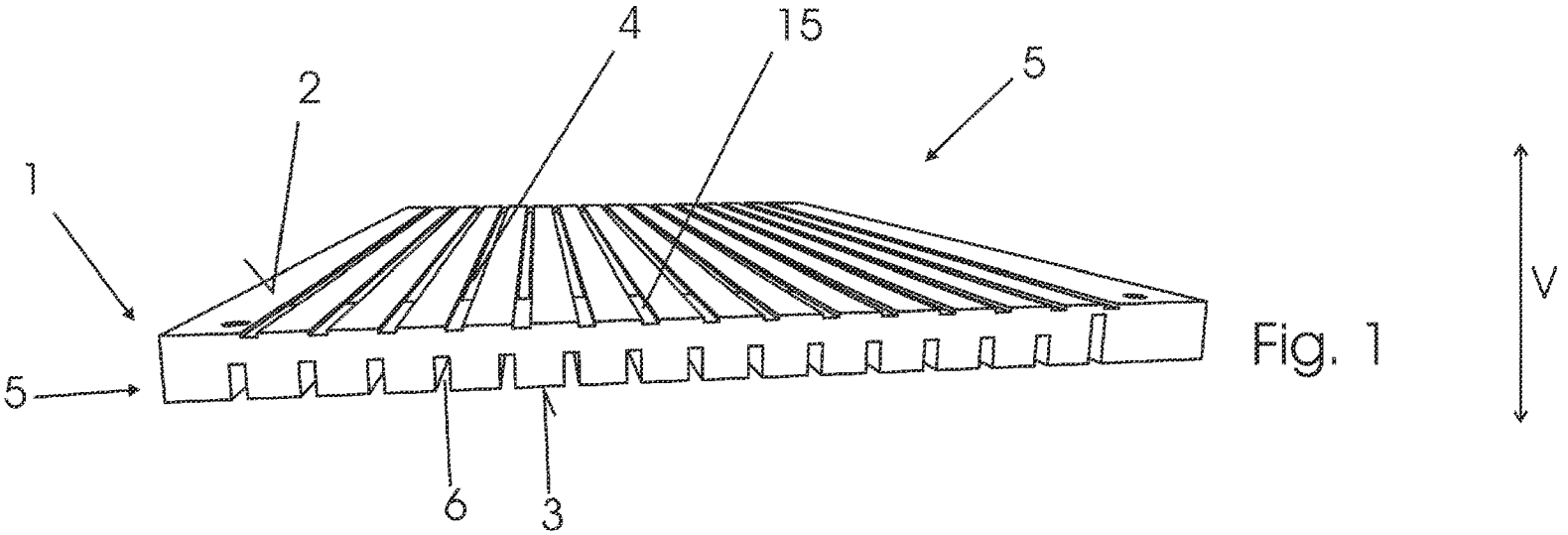
FIG. 1: shows schematically a first embodiment of an acoustic panel in a perspective view.

FIG. 1 shows schematically an acoustic panel 1 according to the invention with a front face 2 and a rear face 3 in a perspective view. The acoustic panel has a carrier board 8 with a decorative laminate coating which forms the front face 2 and a rear-face backing layer (not shown here). Alternatively, the decorative coating and the rear-face coating may also be lacquered-on, laminated-on or similarly applied onto the surface.

Starting from the front face 2, front-face recesses 4 are incorporated in the acoustic panel 1. The recesses 4 are configured in a slot-shaped manner. The recesses are produced as slot-shaped grooves (see also FIG. 2), i.e. the front-face recesses 4 do not pass entirely through the acoustic panel 1 in the vertical direction V. Moreover, the recesses are configured to be inset, i.e. they do not continue entirely through the acoustic panel in the longitudinal axial direction but they are discontinued in the end regions 5. In order to produce the visual impression of continuous grooves, decorative grooves 15 are incorporated in the surface in the end regions. For each front-face recess 4 a rear-face recess 6 is incorporated in the acoustic panel 1 starting from the rear face 3. The front-face recess 4 and the rear-face recess 6 are connected via a through-opening 7 (see FIGS. 2 and 4).

The carrier board 8 is made of wood-based material, in this case a fiber board. The upper-face decorative coating and the rear-face backing layer coating, as already mentioned, are not shown here.

Figure 3:
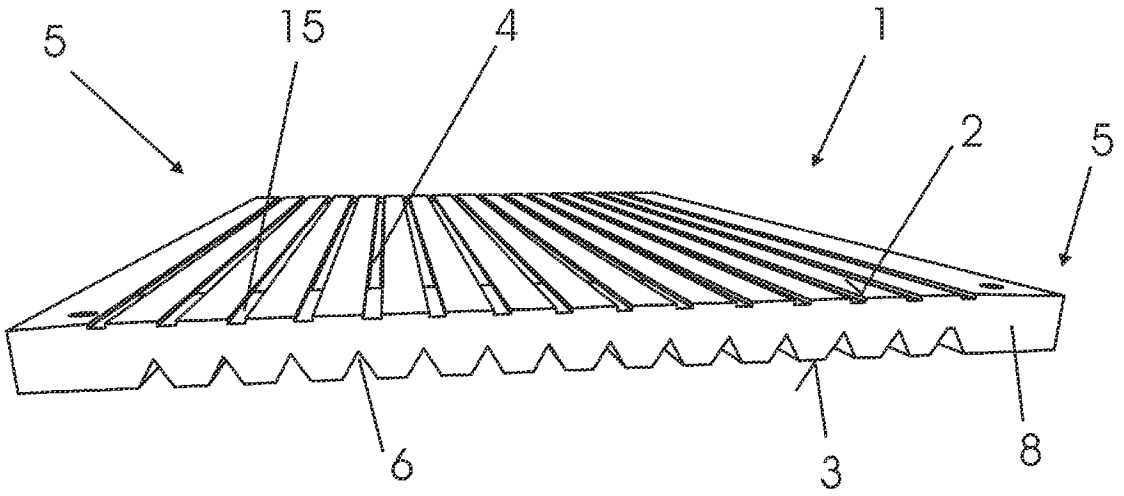
FIG. 3: shows schematically a second embodiment of the acoustic panel in a perspective view.

The embodiment of FIG. 3 differs relative to the embodiment of FIG. 1 in that the rear-face recesses 6 are trapezoidal in cross section.

Figure 2:
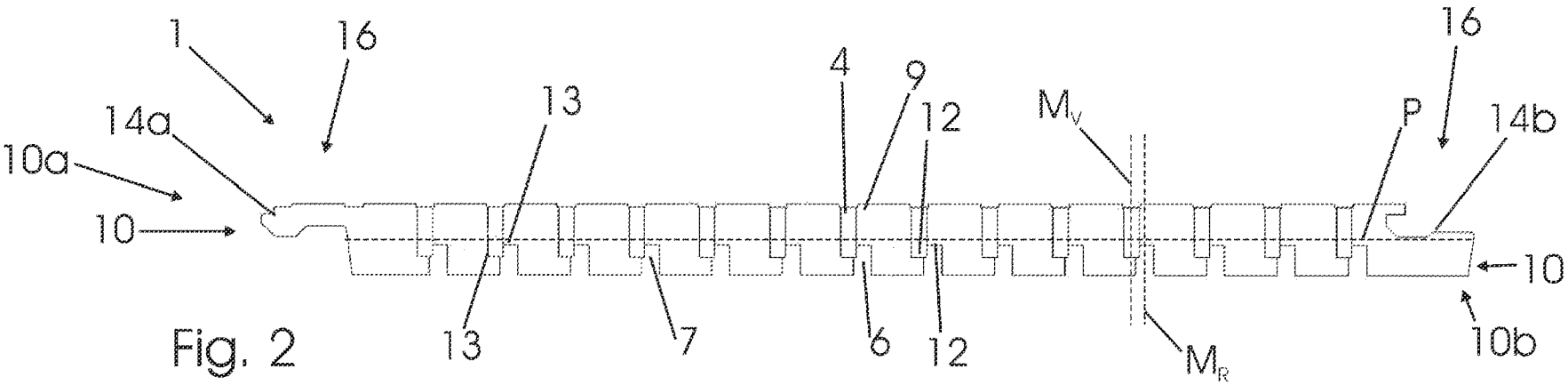
FIG. 2: shows schematically the embodiment of the acoustic panel of FIG. 1 in a cross section.
Figure 4:
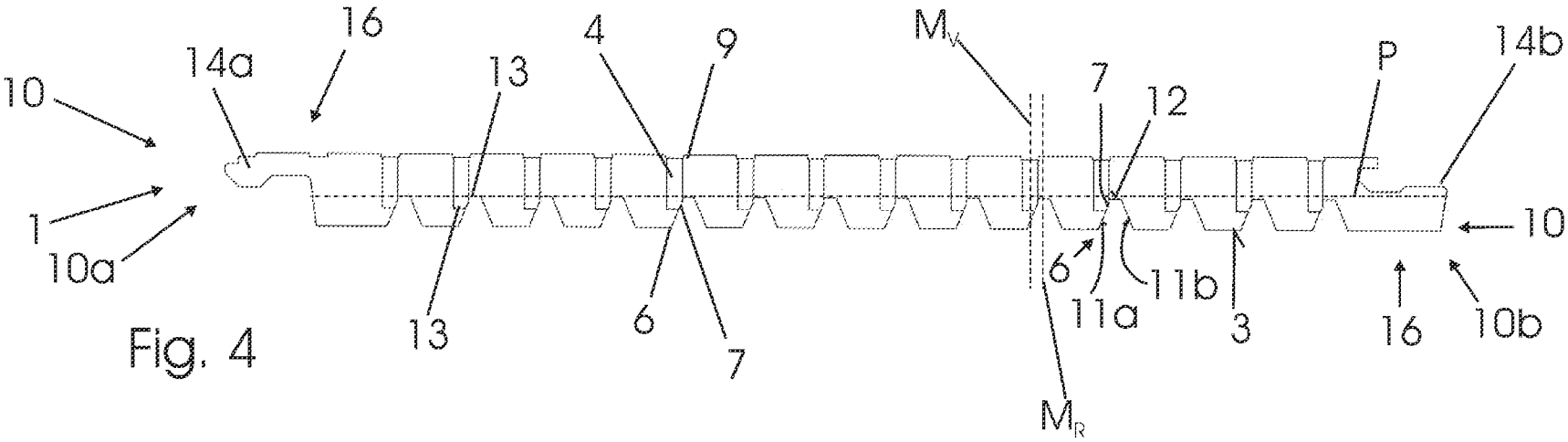
FIG. 4: shows schematically the embodiment of the acoustic panel of FIG. 3 in a cross section.

In FIGS. 2 and 4 the two embodiments are shown in cross section. It is possible to see clearly the corresponding locking profiles 16, which are lockable without the use of adhesive and which are arranged on the side edges 10*a*, 10*b* of the acoustic panels 1, and which have not been shown in FIGS. 1 and 3 for the sake of simplicity. The locking profiles 16 have on a first side edge 10*a* an upper groove cheek 14*a* and on the second side edge 10*b* opposing the first side edge a lower groove cheek 14*b* and are configured in this case as turn-swivel profiles. The locking profiles 16 form a profile plane P.

It may be clearly seen that the front-face recesses 4, which are configured in a rectangular manner, starting from the front face 2 protrude to below the profile plane P. Starting from the rear face 3, however, the rear-face recesses 6 terminate in the vertical direction V in front of the profile plane P. The front-face and rear-face recess 4, 6 overlap in the vertical direction V.

The central longitudinal axes $M_V$ oriented in the vertical direction V of the front-face recesses 4 in the direction transversely to the longitudinal axial direction Q of the acoustic panels 1 are arranged offset to the central longitudinal axes $M_R$ of the respective rear-face recess 6 which is connected via a through-opening 7. In other words, the front-face recess 4 and rear-face recess 6 which are respectively connected via a through-opening 7 are arranged offset to one another.

Due to the prescribed respective depth of the recesses 4, 6, the recesses 4, 6 which are connected via a through-opening 7 are also arranged overlapping in the vertical direction V. Both the front-face recess 4 and the rear-face recess 6 thus form in each case a fold 13 which prevents the view through the acoustic panel 1 from a front face 2 and the passage of particles from the rear face 3. In the embodiment shown, the respective front-face recess 4 is closer to an upper groove cheek 14*a* of the locking profiles 16 than the respective rear-face recess 6.

In a further preferred embodiment, but which is not shown here, the rear-face recess 6 is closer to the upper groove cheek 14*a* relative to the associated front-face recess 4.

The front-face recesses 4 and rear-face recesses 6 shown in FIG. 2 are shown in each case as grooves with a rectangular cross section. The front-face recesses 4 in this case are ca. 2.5 mm wide, whilst the rear-face recesses 6 are ca. 3 mm wide. For improving the sound absorption, the front-face recess 4 is additionally configured to be widened in the surface region 9, i.e. here in the region of up to ca. 1 mm deep. As a result, a significantly improved absorption of sound waves is implemented in the front-face recess 4.

In contrast to the embodiment shown in FIG. 2, the embodiment shown in FIG. 4 has rear-face recesses 6 with side surfaces 11, 11*b* which are arranged obliquely to the vertical direction. The side surfaces 11*a*, 11*b* are arranged in this case at an angle of 23° to the vertical V so that the lower-face recess 6 opens (widens) toward the rear face 3. The rear-face recess 6 is thus configured, as already mentioned, to be trapezoidal.

Whilst in the embodiment shown in FIGS. 1 and 2 the through-openings 7 in each case form a plane oriented parallel to the vertical direction V, the planes of the through-opening 7 formed by the embodiments shown in FIGS. 3 and 4 are arranged at least partially obliquely to the vertical V. The through-opening 7 extends over the entire length of the front-face recess 4.

Also in FIG. 4 the front-face recess 4 is arranged relative to the associated rear-face recess 6 closer to the upper groove cheek 14*a* of the longitudinal-side locking profile 16. An embodiment, which is preferred and not shown, also has in this case a reverse arrangement in which the rear-face recess 6 is arranged in the transverse direction Q closer to the upper groove cheek 14*a* relative to the associated front-face recess 4.

LIST OF REFERENCE NUMERALS

1. Acoustic panel
2. Front face
3. Rear face
4. Front-face recess
5. End region
6. Rear-face recess
7. Through-opening
8. Carrier board
9. Surface region
10. Longitudinal-side locking profiles
10*a*. First side edge
10*b*. Second side edge
11*a*. Side surface
11*b*. Side surface
12. Recess base
13. Fold
14*a*. Upper groove cheek
14*b*. Lower groove cheek
15. Decorative grooves
16. Locking profiles
P Profile plane
V Vertical direction
Q Transversely to longitudinal axial direction
$M_V$ Central longitudinal axis
$M_R$ Central longitudinal axis

The invention claimed is:

1. An acoustic panel (1) for producing a wall and ceiling covering, comprising
a front face (2) and a rear face (3), and
recesses (4, 6) which extend from the front face (2) and from the rear face (3) into the acoustic panel (1),
wherein at least one front-face recess (4) and one rear-face recess (6) are arranged so as to be offset from one another in sections and comprise a through-opening (7) wherein
locking profiles (16), which correspond to one another and which are lockable to one another without the use of adhesive, are arranged on at least two opposing side edges (10*a*, 10*b*) and
the front-face recesses (4) protrude to below a profile plane (P) of the acoustic panel, wherein the profile plane (P), starting from the front face (2), extends parallel to the front face and rear face (2, 3) at the deepest point of the locking profiles (16).

2. The acoustic panel according to claim 1, wherein the front-face and the rear-face recess (4, 6) overlap one another in the direction perpendicular to the panel plane and the through-opening (7) is arranged in an overlapping portion of the recesses (4, 6).

3. The acoustic panel according to claim 1, wherein, in the case of two recesses (4, 6) forming a through-opening (7), the front-face recess (4) protrudes more deeply into the acoustic panel (1) relative to the rear-face recess (6).

4. The acoustic panel according to claim 1, wherein the ratio between the panel thickness and the depth of the front-face recess (4) and the depth of the rear-face recess (6) is 10:7:6 to 13:9:5.

5. The acoustic panel according to claim 1, wherein the front-face recess (4) has a width ratio of 2.5:3 relative to the rear-face recess (6).

6. The acoustic panel according to claim 1, wherein the recesses (4, 6) are configured as grooves.

7. The acoustic panel according to claim 1, wherein the through-opening (7) extends over the entire length of the front-face recess (4).

8. The acoustic panel according to claim 1, wherein each of the recesses (4, 6) has a fold (13) in the region of a recess base (12).

9. The acoustic panel according to claim 1, wherein the rear-face recesses (4) are configured to open toward the rear face (3).

10. The acoustic panel according to claim 1, wherein the plane formed by the through-opening (7) is located in an oblique manner.

11. The acoustic panel according to claim 1, wherein locking profiles (16) are, in particular, turn-swivel and/or push button profiles.

12. The acoustic panel according to claim 1, wherein in the case of two recesses (4, 6) forming a through-opening (7), the spacing of the rear-face recess (6) from a side edge (10*a*, 10*b*) with an upper groove cheek (14*a*) is smaller relative to the spacing of the front-face recess (4) from the side edge (10*a*, 10*b*) with the upper groove cheek (14*a*).

13. The acoustic panel according to claim 1, wherein the front-face recess (4) in the region up to a depth of 20% is 10% to 50% wider relative to the recess width.

14. A wall and ceiling covering comprising acoustic panels (1) according to claim 1, which are fastened to a substructure, wherein a sound-attenuating absorber is arranged adjoining a rear face (3) of the acoustic panels (1).

* * * * *